US006332415B2

(12) United States Patent
Hinsperger et al.

(10) Patent No.: US 6,332,415 B2
(45) Date of Patent: Dec. 25, 2001

(54) SEWING MACHINE WITH FABRIC-RETAINING BED AND METHOD FOR SEWING FABRIC THEREON

(75) Inventors: Peter Hinsperger; James Fitchett, both of Mississauga (CA)

(73) Assignee: Hinpergers Poly Industries Ltd., Ontario (CA)

( * ) Notice: Subject to any disclaimer, the term of this patent is extended or adjusted under 35 U.S.C. 154(b) by 0 days.

(21) Appl. No.: 09/739,867

(22) Filed: Dec. 20, 2000

(51) Int. Cl.[7] ..... D03B 73/12
(52) U.S. Cl. ..... 112/217.1; 112/260
(58) Field of Search ..... 112/217.2, 260

(56) References Cited

U.S. PATENT DOCUMENTS

| | | |
|---|---|---|
| 419,781 | 1/1890 | Lindauer . |
| 486,602 | 11/1892 | Morton . |
| 579,255 | 3/1897 | Brock . |
| 678,978 | 7/1901 | Reid . |
| 776,355 | 11/1904 | Selander . |
| 845,490 | 2/1907 | Thompson et al. . |
| 1,059,606 | 4/1913 | Griffin . |
| 1,216,945 | 2/1917 | Christie . |
| 1,223,075 | 4/1917 | Kidder . |
| 1,342,686 | 6/1920 | McCracken . |
| 1,608,965 | 11/1926 | Taigman . |
| 1,679,514 | 8/1928 | Brown . |
| 2,495,524 | 1/1950 | Hogan . |
| 2,660,496 | 11/1953 | Lake . |
| 3,290,108 | 12/1966 | Beckman et al. . |
| 4,725,106 | 2/1988 | Shields et al. . |
| 5,592,884 | 1/1997 | Glick et al. . |
| 6,003,963 | 12/1999 | Grender . |

*Primary Examiner*—Andy Falik
(74) *Attorney, Agent, or Firm*—McFadden, Fincham

(57) ABSTRACT

A sewing machine for sewing large work pieces such as sails or tarps, has a sewing bed with a large trough, the axis of which is perpendicular to the axis of the sewing head support arm. Fabric is held within the trough, either by being folded, bunched or rolled, with fabric being either fed into the trough as stitching progresses, or is drawn out of the trough during stitching. The fabric may be rolled, bunched or folded within the trough. The trough may be selectively covered with a removable cover plate, to provide a flat sewing bed for sewing of smaller pieces of fabric.

7 Claims, 3 Drawing Sheets

SEWING MACHINE WITH FABRIC-RETAINING BED AND METHOD FOR SEWING FABRIC THEREON

FIELD OF THE INVENTION

The present invention relates to sewing machines, and in particular to commercial machines used for sewing large sails, tarps or the like. The invention relates more particularly to the bed portion of a sewing machine wherein the bed is modified to facilitate use of the machine with large sheets of fabric. The invention also relates to methods of sewing large fabric work pieces.

BACKGROUND OF THE INVENTION

Sewing machines, and in particular industrial or commercial sewing machines, are often used in the sewing of large pieces of fabric, such as sails, large tarps, swimming pool covers, and the like. For such uses, a sewing machine may be provided with an extended arm to accommodate a large amount of fabric inboard of the machine underneath the sewing arm. In some cases, the sewing arm can be six feet or more, to accommodate large sections of fabric bunched or folded in the space under the arm. In the prior art conventional machines (see FIG. 1), the sewing machine bed is flat, and may be formed by a heavy polished steel plate. It will be apparent that the longer the length of the sewing arm, the more fabric may be retained under the sewing arm, between the sewing head and the support pillar. By way of an example of a typical use for such a machine, a large tarp or cover may require supporting straps sewn onto the cover at regular intervals. After each strap is sewn onto the cover, the cover is drawn inwardly such that the finished portion is pulled under the sewing arm. The cover must be folded as it is drawn under the arm in order for material to be drawn under the arm for the sewing head to gain access to the location of the next strap. This can require that the fabric be folded a number of times which is time-consuming. The alternative of providing a longer sewing arm, results in a sewing machine of increasing cost, weight and size. There are also functional limitations as to the length of the sewing arm. Accordingly, it is desirable to provide an arrangement for a sewing machine wherein large pieces of fabric may be held between the sewing head and the sewing arm support pillar without requiring careful folding of the fabric.

SUMMARY OF THE INVENTION

It is an object of the present invention to provide an improved sewing machine, specifically adapted for retaining fabric underneath the sewing arm and inboard of the sewing machine, such that the fabric inboard of the machine does not have to be folded. More specifically, it is an object to provide a sewing machine having a base portion, which permits fabric to be easily rolled or bunched underneath the sewing arm. It is also an object to provide a method for sewing fabric, which permits large work pieces to be sewn with a reduced amount of labour when drawing the fabric under the sewing head.

According to one aspect, the invention comprises a sewing machine characterized by a base, a sewing arm support extending upwards from the base, a generally horizontal sewing arm above the base, and a sewing head at a terminal end of the arm. A conventional motor drives the sewing head. The base comprises a support structure and a sewing bed which comprises a flat work surface in the region under the sewing head. The region of the bed between the work surface and the arm support is characterized by a deep trough, the elongate axis of which is perpendicular to the elongate axis of the sewing arm for retaining loose fabric in a rolled, bunched or folded form. The trough may take on any convenient cross-sectional configuration, including a V-shaped or U-shaped cross-sectional shape. Conveniently, the width of the trough extends substantially the full distance between the sewing arm support and the work surface.

In a further aspect, the trough may be selectively covered by a removable flat plate, to selectively achieve a flat sewing bed extending substantially the full length and width of the base. When the plate is in place, it is flush with the work surface.

In another aspect, the invention relates to a method for sewing a large piece of fabric, comprising the steps of:

- providing a sewing machine having a base, a sewing arm support supported by the base, an elongate sewing arm extending above the base and generally the length of the base, terminating in a sewing head, the base being characterized by a trough-shaped depressed region for receiving excess fabric;
- positioning fabric between said sewing head and said base, for stitching by the sewing head, and
- moving said fabric towards said arm support, whereby the fabric between the sewing head and arm support is retained in bunched, folded or rolled form substantially within the trough during the sewing process.

Fabric may be either fed into the trough or drawn out from the trough during the sewing process.

While the present invention is specifically intended for use with commercial sewing machines, it will be seen that with suitable adaptations, the invention is suitable also for home sewing machines.

The term "fabric" used herein refers to any material which is capable of being stitched, sewn or otherwise processed by a sewing machine. "Sewing" or "stitching" refers to any means for joining fabric, including conventional stitching, serging, heat sealing or otherwise.

Having thus generally characterized the invention, the invention will be further described by reference to a detailed description of preferred embodiments thereof, and by reference to the accompanying drawings.

DETAILED DESCRIPTION OF THE PREFERRED EMBODIMENTS

Figure 1:
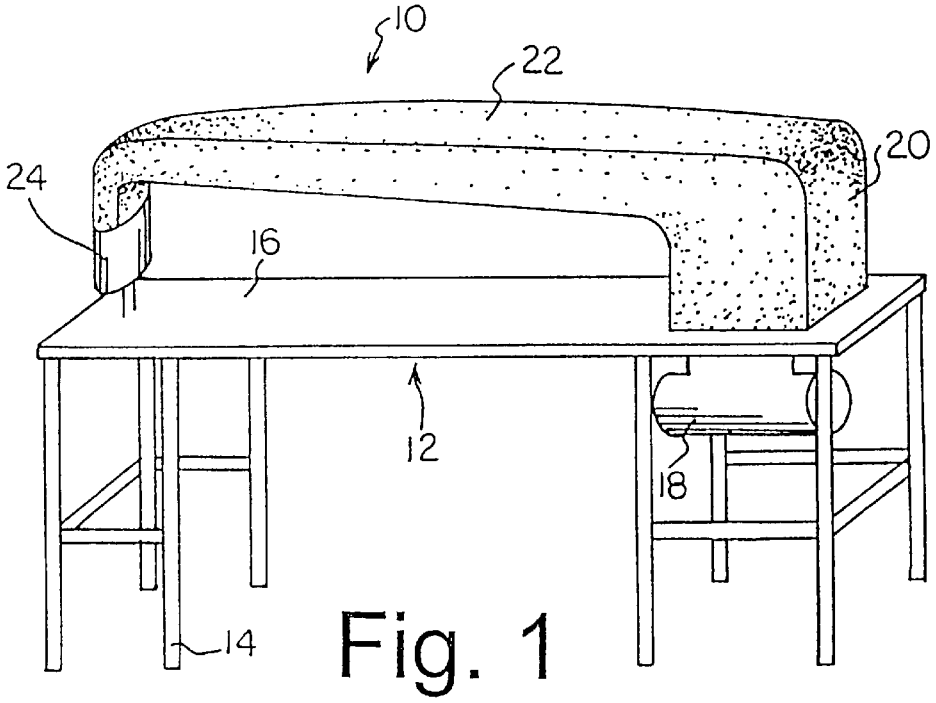
Fig. 1 PRIOR ART
FIG. 1 is a perspective view of a prior art industrial sewing machine.

FIG. 1 illustrates a prior art industrial sewing machine 10, supported on a table-like base 12. The base is comprised of vertical legs 14 and a flat sewing bed 16 which forms a work surface. Typically, the bed is formed from a thick polished steel plate. An electric motor 18 is mounted to the underside of the bed. A support pillar 20 extends generally vertically upwardly from the bed. An elongate arm 22 extends from the pillar 20 to a sewing head 24, generally parallel to the base plate. The sewing head 24 is conventional, and may comprise any type of known sewing or fastening head. It will be understood that this may include either conventional stitching-type machines, or machines which operate via heat-sealing or other fastening methods. The motor is connected to the sewing head via conventional drive linkages, not shown. In a sewing machine intended for use with relatively large fabric work pieces, the sewing arm may be long, in the order of six feet or more. This results in a relatively lengthy bed. The spacing between the base and the sewing arm must be sufficiently great to permit fabric to be easily folded therebetween, which stitching or fastening is carried out on large work pieces.

Figure 2:
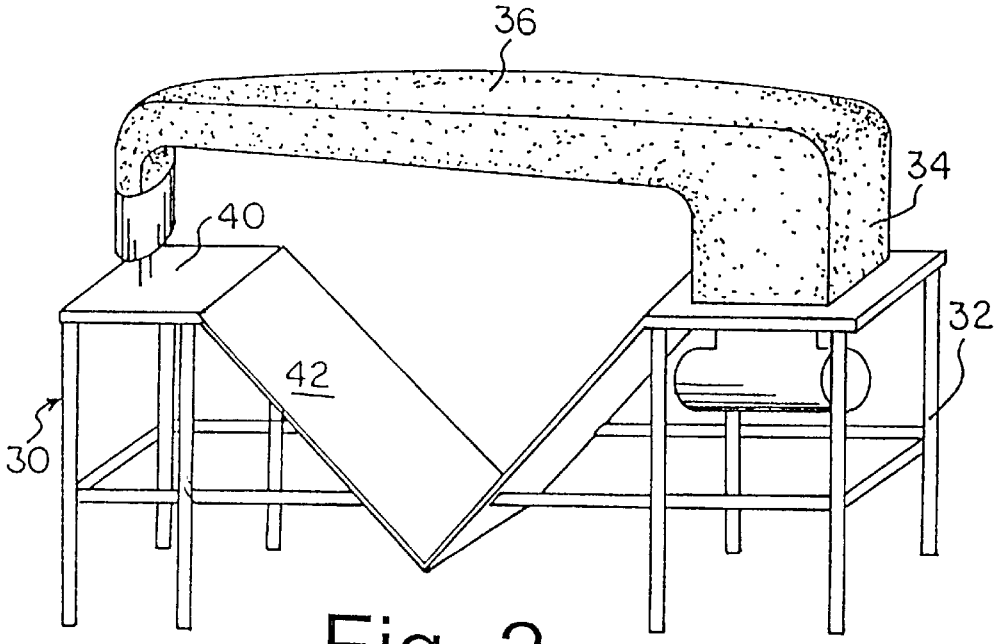
FIG. 2 is a perspective view of a first version of the invention.
Figure 3:
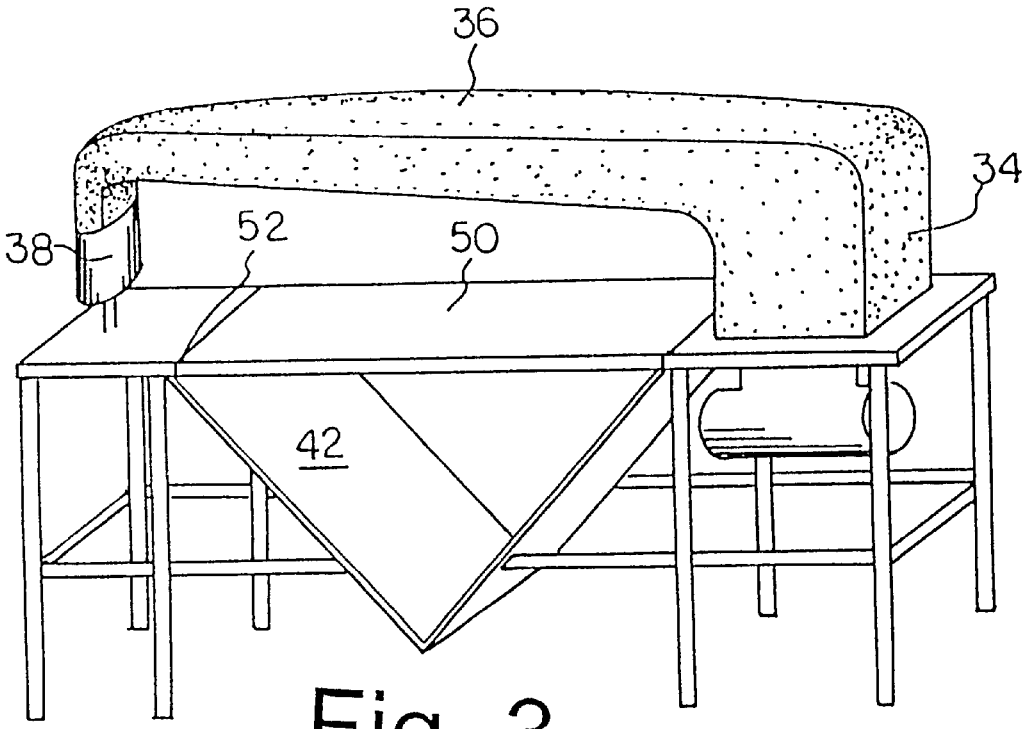
FIG. 3 is a perspective view of the invention as in FIG. 1, with the removable base plate installed.
Figure 5:
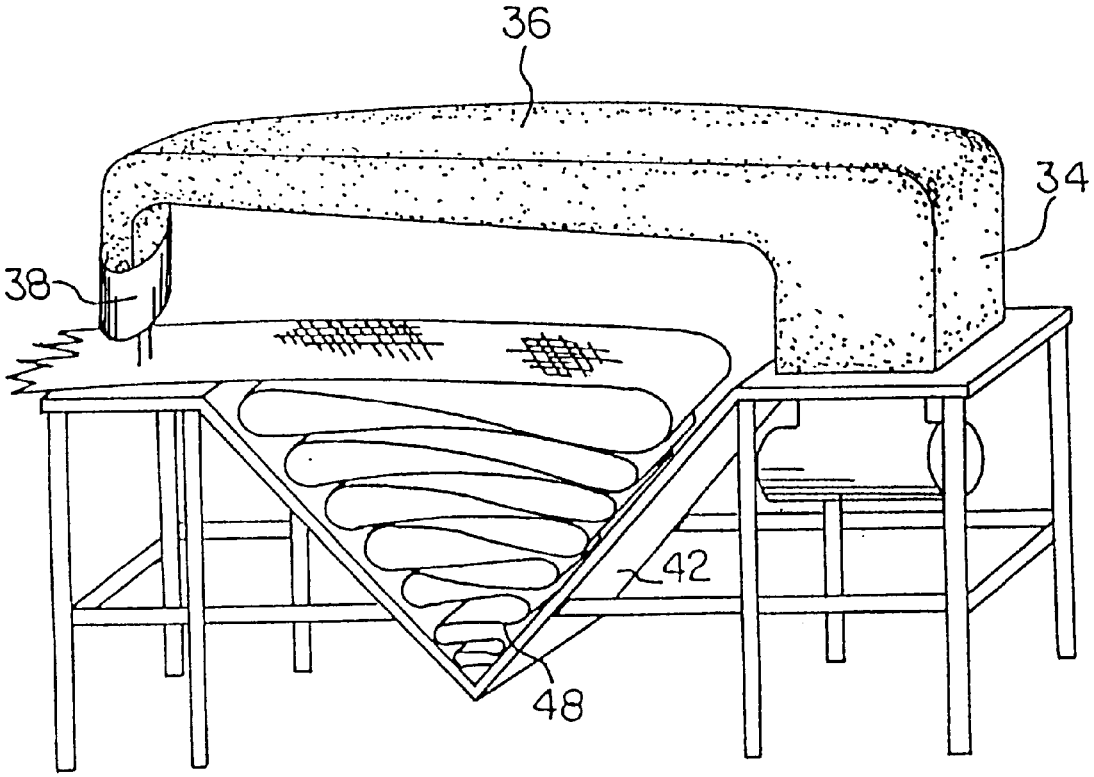
FIG. 5 is a perspective view of the invention, showing a fabric work piece bunched within the trough.

A first embodiment of the present invention is shown in FIGS. 2, 3 and 5. In this version, the base 30 is comprised of vertical legs 32, which support a prior art-type support 34, arm 36 and head 38. The sewing work surface 40 is at the left on FIGS. 2 and 3, and is comprised of a relatively small flat surface generally underneath the sewing machine head 38. The work surface 40 includes a conventional recess for receiving a sewing machine needle, optionally a thread bobbin holder, and other arrangements associated with a conventional sewing machine work surface. These components are not illustrated, but are conventional. The middle region of the sewing bed forms a deep V-shaped trough or recess 42, extending from the work surface 40 to adjacent the support pillar 34. The base of the trough 42 extends substantially to ground level. The trough may be formed from plate steel as in the sewing bed of a prior art-type machine. The axis of the trough is perpendicular to the elongate axis of the sewing machine arm. Upon stitching of fabric 48 (see FIG. 5), the fabric is passed under the sewing machine head in the direction of the support pillar and falls into the trough. Within the trough, the fabric may be folded, bunched or rolled. Since a substantial volume of material may be held within the trough 42, it is typically not necessary for the user to carefully fold the fabric after the same is pulled under the sewing arm 36, unless the fabric is exceptionally large and/or thick. It is contemplated that in most cases, the fabric will simply be bunched into the trough, as the fabric is drawn past the sewing head 38. Alternatively, the fabric may be drawn into the trough by means of a roller (not shown). In an alternative use, fabric may be initially held in the trough and drawn out during the sewing, with the finished work piece being pulled outwardly under the sewing head away from the machine.

In a further aspect, a removable plate 50 selectively covers the trough, as shown in FIG. 3. When the plate is removed, the trough is exposed for use with large work pieces such as sails, large tarps, etc. However, when it is desired to use the sewing machine for more conventional smaller work pieces, it may be desirable to provide a flat sewing bed. Retainer means are provided wherein the removable plate may rest on flanges or slots 52 on either side of the trough, and fastened by means of bolts or pins, not shown. Preferably the removable plate is formed from the same heavy polished steel plate as forms the sewing bed of the conventional art. It will be seen that any suitable means of releasably fastening the removable plate to the sewing bed may be provided. The plate is retained on the bed such that it is flush with the work surface.

Figure 4:
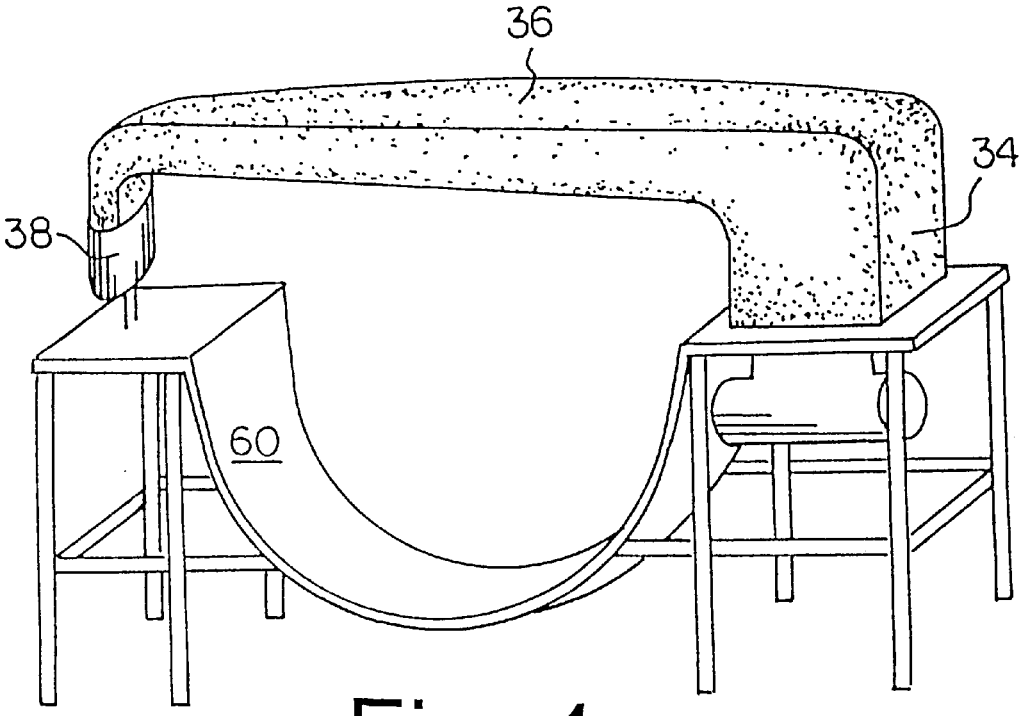
FIG. 4 is a perspective view of a further embodiment of the invention.

In another aspect, the trough may take on a configuration other than V-shaped in cross-section. For example, as shown in FIG. 4, the trough 60 may be U-shaped in section. This achieves a greater interior volume within the trough for retaining larger fabric pieces.

FIG. 5 illustrates the embodiment of FIG. 2, with a large fabric work piece 48 being bunched within the fabric-retaining trough 42. In use, the trough may hold either fabric which has already been stitched, in which case the fabric is drawn into the trough after the stitching is completed, or alternatively, the unstitched material may be retained within the trough and drawn out of the trough as the stitching is carried out.

To one skilled in the art to which this invention pertains, the foregoing provides a general characterization and a detailed description of the preferred embodiments of the invention. However, it will be seen that the present invention encompasses the full range and scope of the invention defined in the claims of this patent specification.

We claim:

1. A sewing machine comprised of a base, an elongate arm supportive above said base by an arm support, and a sewing machine head at one end of said arm; said base having a sewing bed having a work surface under said or sewing head; a trough directly between said bed and said arm support, the width of said trough extending substantially between said support and said work surface, the elongate axis of said trough being perpendicular to said arm, said trough for receiving therein fabric being stitched or otherwise processed by said head.

2. A sewing machine as defined in claim 1, wherein said trough is generally V-shaped in cross section.

3. A sewing machine as defined in claim 1, wherein said trough is generally U-shaped in cross-section.

4. A sewing machine as defined in claim 1, further characterized by a removable sewing bed plate for selectively covering said trough, said plate being releasably retained by retainer means on said sewing bed for holding said plate generally flush with said sewing work surface.

5. A method for sewing large fabric pieces, comprising the steps of providing a sewing machine having a base for supporting a bed, an arm supported above said base by an arm support, and a sewing head bed at an end of said arm, said sewing bed having a work surface underneath said sewing head, said sewing bed characterized by a trough directing between said work surface and said arm support, the elongate axis of said trough being perpendicular to the axis of said sewing arm extending under said sewing arm, said method comprising the steps of sewing a fabric work piece with said sewing head; and drawing said fabric work piece either into or out of said trough wherein fabric within said trough is in a bunched, rolled or folded form as said stitching is carried out.

6. A method as defined in claim 5 comprising the further step of depositing said fabric into said trough following a stitching operation performed with said head.

7. A method as defined in claim 5 comprising the further step of drawing said fabric out from said trough during a stitching operation performed with said head.

* * * * *

UNITED STATES PATENT AND TRADEMARK OFFICE

CERTIFICATE OF CORRECTION

PATENT NO. : 6,332,415 B2
DATED : December 25, 2001
INVENTOR(S) : Hinsperger, J. Peter It is certified that error appears in the above-identified patent and that said Letters Patent is hereby corrected as shown below:

Title page,
Item [73], the name of the Assignee has been corrected from "Hinpergers Poly Industries Ltd." to -- Hinspergers Poly Industries Ltd. --

Signed and Sealed this

Twentieth Day of August, 2002

*Attest:*

*Attesting Officer*

JAMES E. ROGAN
*Director of the United States Patent and Trademark Office*